United States Patent [19]

Morrison et al.

[11] 4,221,375

[45] Sep. 9, 1980

[54] COPY SHEET HANDLING APPARATUS FOR A COPIER

[75] Inventors: Douglas I. Morrison, Norwalk; William Gergely, Jr., Monroe, both of Conn.

[73] Assignee: Pitney Bowes Inc., Stamford, Conn.

[21] Appl. No.: 966,008

[22] Filed: Dec. 4, 1978

[51] Int. Cl.[3] ..... B65H 1/08

[52] U.S. Cl. ..... 271/127; 271/9; 271/159; 271/160; 271/162

[58] Field of Search ..... 271/127, 117, 113, 157–159, 271/160, 9, 148, 162, 164

[56] References Cited

U.S. PATENT DOCUMENTS

| | | | |
|---|---|---|---|
| 3,159,399 | 12/1964 | Davis | 271/210 |
| 3,599,972 | 8/1971 | Miciukiewicz | 271/127 |
| 4,023,792 | 5/1977 | Punnett | 271/127 X |
| 4,131,274 | 12/1978 | Sue | 271/127 X |

*Primary Examiner*—Richard A. Schacher
*Attorney, Agent, or Firm*—Donald P. Walker; William D. Soltow, Jr.; Albert W. Scribner

[57] ABSTRACT

In a copier, copy sheet handling apparatus is provided which includes a pair of feed rollers spaced apart from each other, and a copy sheet tray which extends substantially transversely through a plane which, in turn, extends midway between the feed rollers. Further, the copy sheet handling apparatus includes structure for swivelably supporting the tray in the aforesaid plane; and instrumentalities cooperative with the supporting structure for applying a resilient force to the tray substantially in the aforesaid plane to move the tray toward the feed rollers for disposition of a copy sheet into engagement with the feed rollers, whereby the force is substantially equally distributed between the feed rollers.

5 Claims, 10 Drawing Figures

COPY SHEET HANDLING APPARATUS FOR A COPIER

BACKGROUND OF THE INVENTION

Commercially available electrostatic copying machines or copiers, generally include processing apparatus for forming and developing an electrostatic latent image on a moving photoreceptor and thereafter transferring the developed image from the photoreceptor to a copy sheet made of a suitable material such as paper. Thus the copiers are provided with copy sheet handling apparatus including suitable means for supplying copy sheets, feeding the copy sheets to the processing apparatus and collecting the processed copy sheets.

The feeding means typically includes a pair of rollers spaced apart from each other and fixedly mounted on a rotatable shaft, for rotating the rollers in engagement with the top sheet of a stack of copy sheets loaded in the copy sheet supplying means.

The copy sheet supplying means typically includes a shallow receptacle, or supply tray, which is periodically replenished with a stack of copy sheets. To facilitate replenishing the supply tray it is well known in the art to lower the tray away from the feed rollers, against spring tension exerted on the tray; and, while manually holding the tray against such spring tension, to load a new stack of sheets on the tray. Whereupon the tray may be released to allow the spring to raise the tray toward the feed rollers for urging the topmost sheet into engagement with the respective feed rollers. However, in such arrangements it has been a long standing problem to evenly distribute the force, exerted by the copy sheet against the feed rollers, between the respective feed rollers. As a result of which, the feed rollers skew the copy sheets in the course of feeding the same or otherwise misfeed the copy sheets to the processing means. Accordingly:

An object of the present invention is to provide a copier including improved apparatus for handling the copy sheets;

Another object is to provide, in a copier including a pair of spaced feed rollers against which copy sheets are spring urged for feeding purposes, copy sheet handling apparatus constructed and arranged to evenly distribute the spring force between the feed roller when the copy sheets are spring urged thereagainst; and Yet another object is to provide copy sheet handling apparatus that facilitates loading copy sheets in a copier.

SUMMARY OF THE INVENTION

In a copier, there is provided copy sheet handling apparatus comprising copy sheet feeding means including a pair of feed rollers spaced apart from each other; copy sheet supplying means including a tray on which a copy sheet may be loaded, wherein the tray extends substantially transversely through a plane which, in turn, extends midway between the feed rollers; means for swivelably supporting the tray; and means cooperative with the supporting means, for moving said tray, wherein the moving means includes means for applying a resilient force to the tray substantially in said plane to move the tray toward the feed rollers for disposition of the copy sheet into engagement with the feed rollers, whereby said force is substantially equally distributed between the feed rollers.

BRIEF DESCRIPTION OF THE DRAWINGS

As shown in the drawings, wherein like reference numerals designate like or corresponding parts throughout the several figures.

DESCRIPTION OF THE PREFERRED EMBODIMENT

Figure 1:
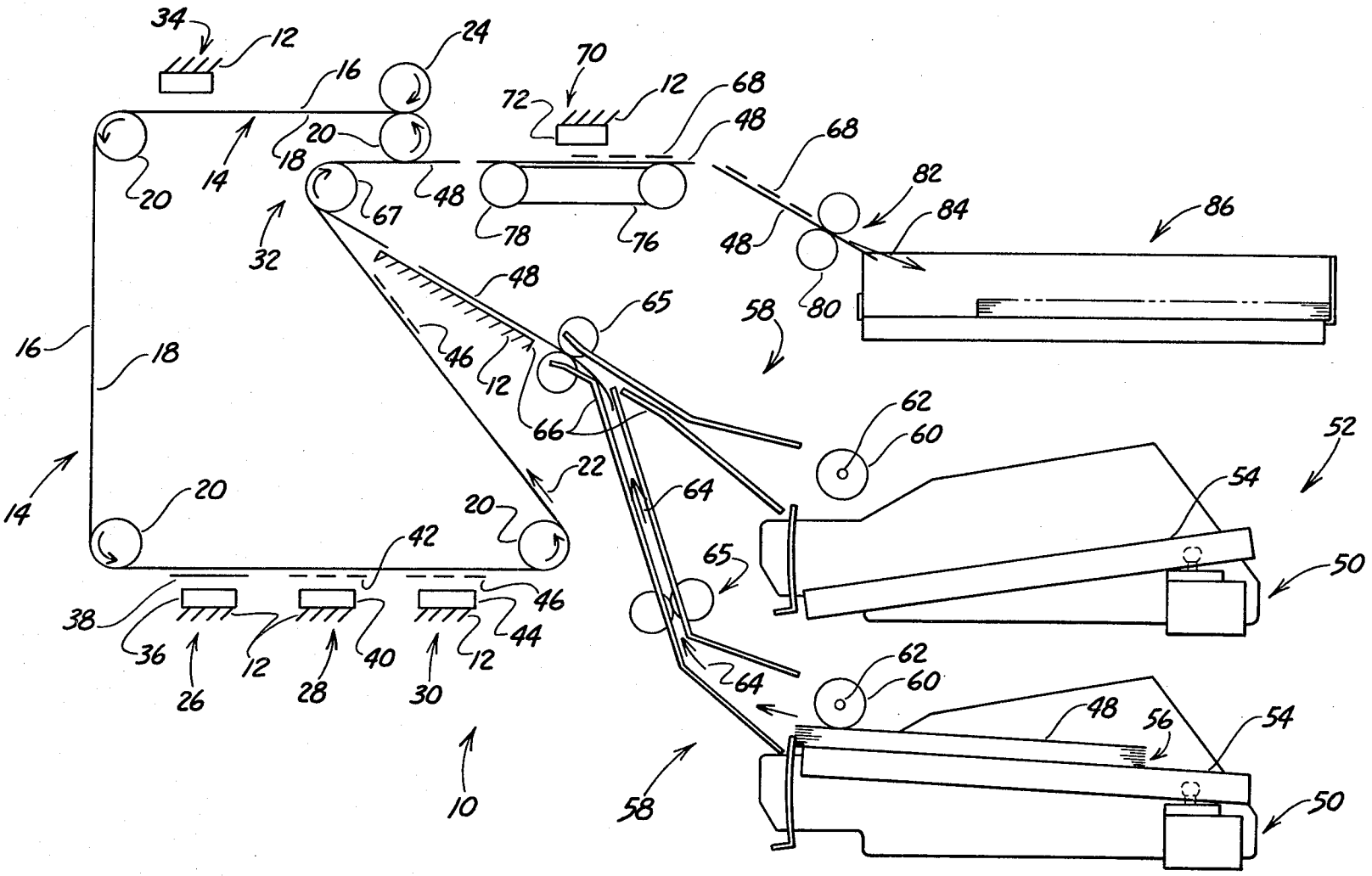
FIG. 1 is a schematic view of a copier according to the Invention.

As shown in FIG. 1, an electrostatic copying machine, or copier, 10, of the type which may be improved in accordance with the present invention, generally includes suitable framework 12 for supporting the various processing means of the copier 10, including a photoreceptor 14. The photoreceptor 14 comprises a suitable flexible endless web having an outer surface 16 treated to exhibit photoreceptor characteristics, and an inner surface 18.

To movably support the photoreceptor 14 (FIG. 1), the processing means includes a plurality of elongated rotatable idler shafts 20 about which the photoreceptor 14 is suitably endlessly looped, with its inner surface 18 disposed in engagement with the respective shafts 20. The idler shafts 20 are suitably secured to the framework 12 so as to longitudinally extend transverse to a desired path of travel 22 of the photoreceptor 14. In addition, the processing means includes an elongated suitably driven shaft 24, rotatable in engagement with the outer surface 16 of the photoreceptor 14, to move the photoreceptor 14 in the aforesaid path of travel 22, through a charging station 26, imaging station 28, developing station 30, transfer station 32, and cleaning station 34.

At the charging station 26, (FIG. 1) the processing means includes suitable corona charging means 36 for depositing an array of electrostatic charge 38 of suitable polarity on the photoreceptor's outer surface 16.

At the imaging station 28 (FIG. 1) the processing means includes suitable electro-optical means 40 for providing the photoreceptor 14 with suitable information, from a graphic image (not shown) carried by a document (not shown), causing the photoreceptor 14 to conduct and dissipate sufficient charge 38 from the photoreceptor's outer surface 16 to provide the same with a developable electrostatic latent image 42.

At the developing station 30, (FIG. 1), the processing means includes suitable means 44 for developing the latent image 42 so as to render the same visible, thereby forming a transferable, developed image 46 on the outer surface 16 of the moving photoreceptor 14.

At the transfer station 32 the developed image 46 (FIG. 1) is transferred from the photoreceptor surface 16 to a suitable copy sheet 48 such as a sheet of paper.

To that end, the copier 10 (FIG. 1) includes copy sheet handling apparatus 50, located at a copy sheet storage station 52. The copy sheet handling apparatus 50 generally comprises copy sheet supplying means 54 on which there may be loaded a stack 56 of copy sheets 48; and suitable sheet feeding means 58 for feeding top sheets 48 from the stack 56. The sheet feeding means 58 includes a pair of feed rollers 60 (FIG. 2) spaced apart from each other and fixedly mounted on an elongated rotatable shaft 62. The shaft 62 is suitably supported by the framework 12 so as to longitudinally extend transverse to a suitable path of travel 64 for copy sheets 48 to be fed to the transfer station 32. The shaft 62 is driven by means well-known in the art for rotating the feed rollers 60 in engagement with respective topmost copy sheets 48 in the stack 56.

The processing means of the copier 10 may also include additional copy sheet feed rollers 65 and associated guide means 66 for feeding the copy sheets 48 in the desired path of travel 64 to the transfer station 32.

At the transfer station 32 (FIG. 1) the processing means includes an elongated, rotatable shaft 67 suitably secured to the framework 12 so as to longitudinally extend transverse to the respective paths of travel, 22 and 64, of the moving photoreceptor 14 and copy sheet 48. The rotating shaft 67 is disposed in engagement with the moving copy sheet 48, and insufficiently close proximity to the moving photoreceptor 14 to forceably urge the copy sheet 48 into sufficiently intimate engagement with the image bearing outer surface 16 of the moving photoreceptor 14 to transfer the developed image 46 to the copy sheet 48. To facilitate image transfer, the shaft 67 may be appropriately charged to urge the developed image 46 on to the copy sheet 48. The copy sheet 48, with a transferred image 68 thereby formed thereon is then fed to a fusing station 70 of the copier 10.

At the fusing station 70 the processing means includes suitable means 72 for fusing the transferred image 68 to the copy sheet 48 through the application of heat or pressure, or both. To that end, the fusing means 72 includes a suitable image bonding device such as a cold-roll, hot-roll or heat-box type fuser suitably secured to the framework 12.

At or beyond the fusing station 70 (FIG. 1) the processing means includes suitable means for delivering processed copy sheets 48 to the operator, including for example, a movable belt 76, idler shaft 78, and rotatable driven shaft 80 and suitably located roller means 82. The processed copy sheet 48 is carried on the moving belt 76 through the fuser 72, and delivered by the roller means 82 in a desired path of travel 84 to a processed copy sheet receiving station 86.

According to the invention, the copy sheet handling apparatus 50 (FIG. 1) comprises means 54 for supplying copy sheets 48 including a tray 90 (FIG. 2) on which copy sheets 48 may be loaded. The tray 90 has a forward end 92 and a rear end 94 and includes a rectangularly-shaped base 96. The forward end 92 of the tray 90 is normally disposed beneath the copy sheet feed rollers 60. The tray 90 also includes opposed, depending side walls 98 and a depending rear wall 100. In addition, the tray 90 includes opposed upwardly extending side walls 102, each of which preferably includes a foot portion 104 having a recessed slot 106 formed therein to receive a fastener 108 which connects the side wall foot portion 104 to the tray base 96 so as to become a part of the tray base 96. With this arrangement the side walls 102 may be moved toward and away from one another to accommodate different widths of copy sheets 48. The tray 90 extends substantially transversely through an imaginary plane 110 (FIG. 9) which extends midway between the feed rollers 60 and side walls 102 of the tray 90.

Figures 8, 8A, 9:
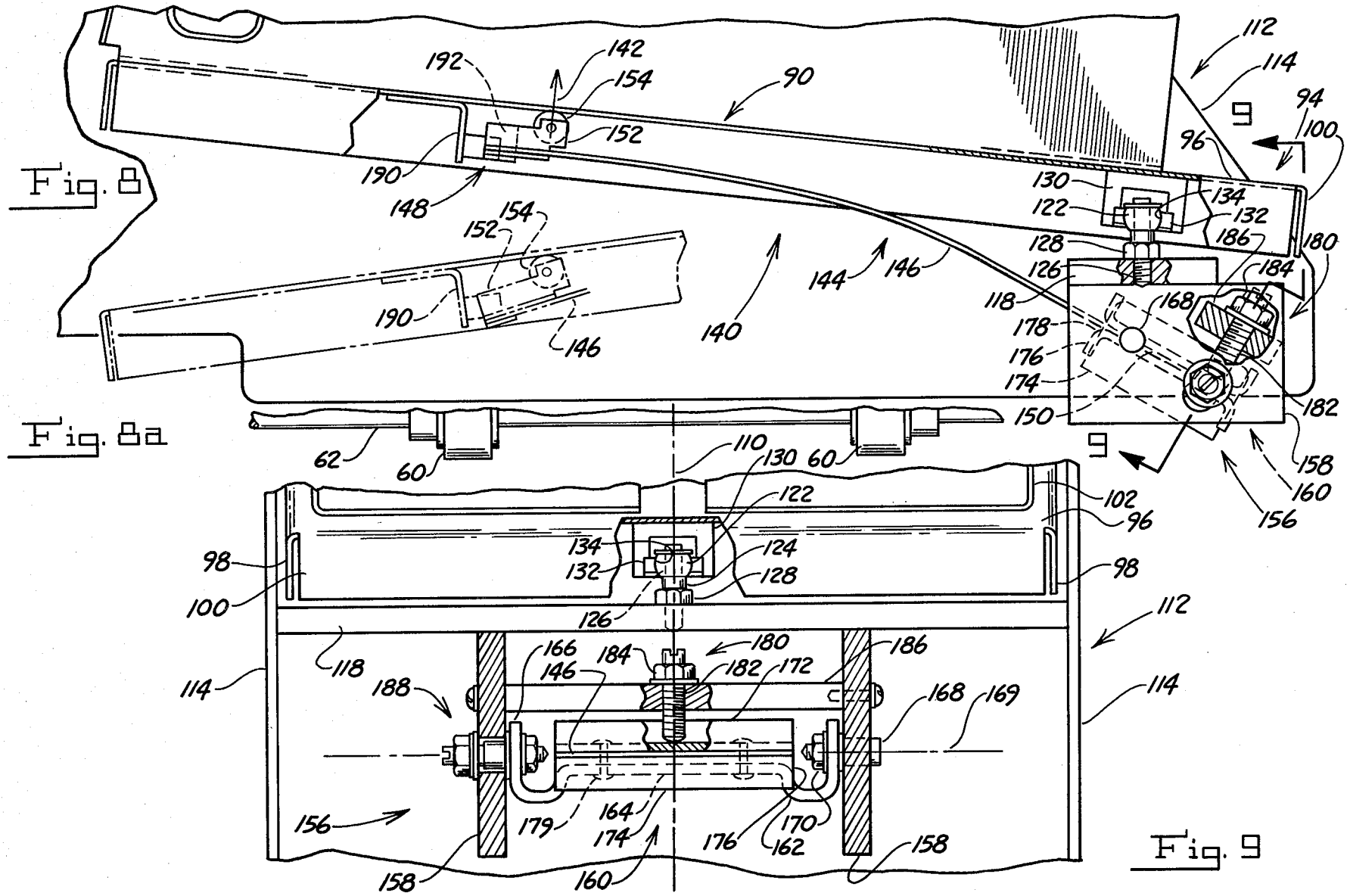
FIG. 8 is a reduced fragmentary view, in elevation, of the apparatus of FIG. 3, showing means for spring urging the supply tray upwardly to maintain the topmost sheet in proper alignment with the sheet feeder.
FIG. 8A is a fragmentary phantom view of the apparatus of FIG. 8, showing the spring means lowered.
FIG. 9 is an end view of the apparatus of FIG. 8, taken substantially along the line 9—9 of FIG. 8.

The copy sheet handling apparatus also includes means for supporting the tray 90, (FIG. 2) including a frame 112. The frame 112 includes a pair of opposed, upright, side walls 114 between which the copy sheet supply tray 90 is transversely disposed. To maintain the side walls 114 in fixed spacial relationship with respect to each other, the frame 112 includes, at its forward end, an elongated transversely-extending spacer member 116; and at its rear end, an elongated transversely-extending spacer member 118. Each of the spacer members, 116 and 118, acts as a tie rod and is suitably fixedly attached to the opposed side walls 114. The frame 112 also includes an upright longitudinally extending plate 120 suitably fixedly attached to the forward spacer member 116 to act as a stop against which the forward end edges of the copy sheets 48 may be aligned when loaded on the tray 90. As shown in FIG. 8, the rear spacer member 118 longitudinally extends beneath the rear end 94 of the supply tray 90. Midway between the ends of the rear spacer member 118 (FIG. 9), and substantially in the aforesaid plane 110 extending midway between the copy sheet feed rollers 60, the frame 112 includes a ball-like member 122 suitably adjustably fixedly connected to the rear spacer member 118 for vertically moving the ball-like member 122 with respect to the rear spacer member 118. To that end, post means 124 may be provided, such as a stud 126 threadably engaged with the rear spacer member 118 and lockable in place thereon as by means of a lock nut 128. In addition, the supporting means includes bracket means 130 disposed in the aforesaid plane 110 extending between the feed rollers 60. The bracket means 130 is fixedly attached to the tray 90, so as to depend therefrom, and includes bearing means 132. The bearing means 132 has a bearing surface 134 which is partially spherically-shaped to receive the ball-like member 122 and to be seated thereon, for swivelably supporting the tray 90 in the aforesaid imaginary plane 110, such that the tray 90 extends substantially transversely through said imaginary plane 110.

The copy sheet handling apparatus additionally includes means cooperative with the supporting means for moving the tray 90. As shown in FIG. 8, the moving means includes means 140 for applying a resilient force 142 to the tray 90, substantially in the aforesaid plane 110 (FIG. 9) for urging the tray 90 against the feed rollers 60, and incrementally moving the tray 90 toward the rollers 60 for continuous disposition of the respective topmost copy sheets 48 in engagement with the rollers 60 as the copy sheets 48 are fed from the tray 90. With this arrangement the force 142 is substantially equally distributed between the rollers 60. The force applying means 140 (FIG. 8) comprises flexure spring means 144 including an elongated flexure spring 146 having a free end 148. The other end 150 of the flexure spring 144 is held stationary. The free end 148 of the flexure spring 146 is adapted for exerting the resilient force 142 against the tray 90 forwardly of the swivable supporting means. To that end, the flexure spring means 144 includes a bracket 152 suitably fixedly attached to the free end 148 of the flexure spring 146, and a roller 154 suitably mounted for rotation in the bracket 152 and disposed in contact with the tray 90 whereby the roller 154 exerts the resilient force 142 against the tray 90.

To hold the other end 150 of the flexure spring 146 stationary, the tray supporting means includes flexure spring holding means 156 (FIGS. 8 and 9) comprising a pair of parallel spaced legs 158 suitably fixedly attached to the rear spacer member 118 of the frame 112 so as to depend therefrom. In addition, the spring holding means 156 includes clamping means 160 disposed between the legs 158 and pivotably connected to the legs 158. The clamping means 160 includes a base member 162. The base member 162 has a flat, centrally disposed portion 164 and opposed upright, side wall portions 166. the side wall portions 166 are each suitably pivotably attached to opposite frame leg 158, as by means of an axially aligned pivot shafts 168, having a pivot axis 169, and a fastener 170. In addition, the clamping means includes upper and lower channel members, 172 and 174, longitudinally extending between the frame legs 158. The upper channel member 172 has an upright, generally U-shaped transverse cross-section. The lower channel member 174 has an inverted, generally U-shaped transverse cross-section and is seated on the central portion 164 of the base member 162 with the respective side wall portions 176 thereof extending downwardly and transverse to the longitudinal length of the spring 146. The flexure spring 146 lengthwise extends across the radius 178 between the forward side wall 176 and base of the lower channel member 176 for ease of bending, and through the pivot axis 169. And, the upper channel member 172 is seated on the flexure spring 146, with the opposed side wall portions thereof extending upwardly. As thus arranged, the spring end 150, base member 162, and upper and lower channel members, 172 and 174, are suitably fixedly clamped together, as by means of fasteners 179, for pivotal movement about the axis 169 of the pivot shafts 168. In addition, the flexure spring holding means 156 (FIGS. 8 and 9) includes means 180 for adjustably fixing the position of the clamping means 160, and thus the spring's held end 150, with respect to the pivot axis 169 for changing the energy stored in the flexure spring 146. The adjusting means 180 includes an adjusting screw 182 and lock nut 184. And, the frame 112 includes a strut 186 extending from the legs 158 for threadably receiving the adjusting screw 182 such that the screw 182 extends through the strut 186 and into bearing engagement with the upper channel member 172 of the clamping means 160, rearwardly of the pivot axis 169. With this arrangement, the adjusting screw may be lowered and raised with respect to the strut 186 for changing the position of the clamping means 160 with respect to the pivot axis 169; thereby to change the energy stored in the flexure spring 146. Preferably, suitable means, such as an anchoring device 188, may be provided to extend through a slot in at least one of the legs 158, for anchoring the base members 162 and thus the clamping means 160 to the leg 158 after adjusting the position of the clamping means 160 with respect to the pivot axis 169.

To restrain relative movement between the tray 90 and flexure spring 146 (FIG. 8) the tray supporting means includes finger means 90 fixedly attached to the tray 90 so as todepend therefrom and extend toward the free end 148 of the flexure spring 146. In addition, the bracket 152 and spring 146 are provided with a vertically extending receive the finger means 190. The finger means 190 and bracket 152 are thereby constructed and arranged to guide on one another for preventing relative sidewise movement between the tray 90 and the flexure spring 146.

Figure 2:
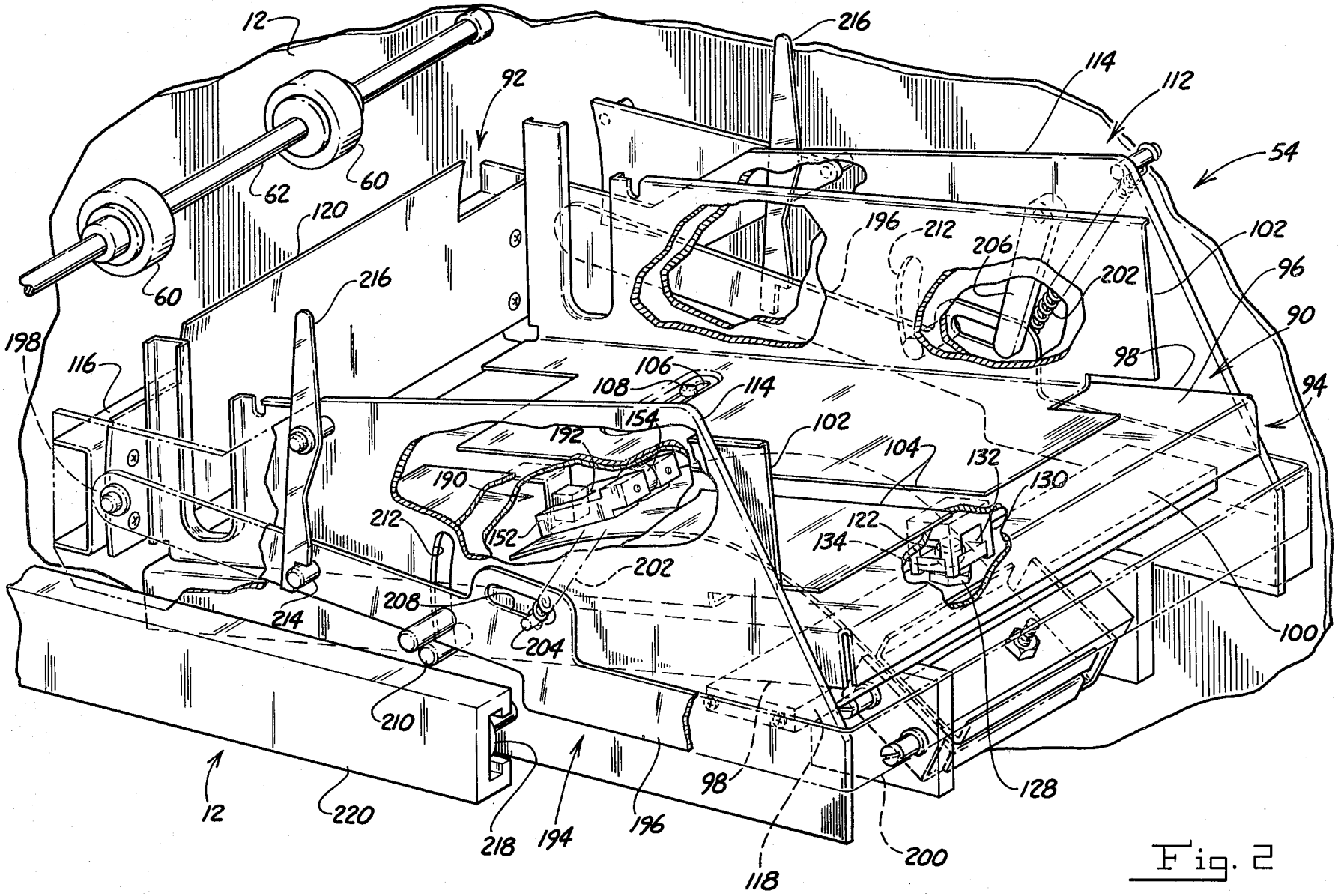
FIG. 2 is a fragmentary, perspective view of copy sheet handling apparatus according to the invention.

The paper handling apparatus additionally includes means cooperative with the supporting means for moving the tray 90 (FIG. 2) away from the rollers 60 against the flexure spring force 142 to facilitate loading copy sheets 48 on the tray 90. To that end, the tray moving means includes lever means 194 comprising a pair of lever arms 196 which are spaced parallel to each other and respectively have one end thereof suitably pivotally attached, as by means of pivots 198 (one of which is shown in FIG. 2), on a one for one basis, to the forward end of the frame 112. The other ends of the respective lever arms 196 are joined to each other by means of a suitable handle 200 extending between the lever arms 196. The handle 200 is disposed sufficiently rearwardly of the respective frame side walls 114 to permit ease of access for the operator.

In addition the tray moving means includes a pair of tension springs 202 (FIG. 2) one of which is associated with each of the lever arms 196. Each of the tension springs 202 has one end suitably fixedly connected to the frame side wall 114 associated therewith, and the other end connected to a pin 204 which extends from the lower end of a crank 206 pivoted at its upper end to the associated side wall 114 forwardly of the aforesaid fixed end of the spring 202. The pin 204 is slidably disposed in a slot 208 formed in the lever arm 196 associated with the spring 202, so as to exert an upwardly and rearwardly directed force on the crank 206. In addition, the tray moving means includes a pair of space camming pins 210, respectively extending in opposite directions from the respective side walls 98 of the tray base 96 through suitable slots 212 formed in the frame side walls 114.

Figure 3:
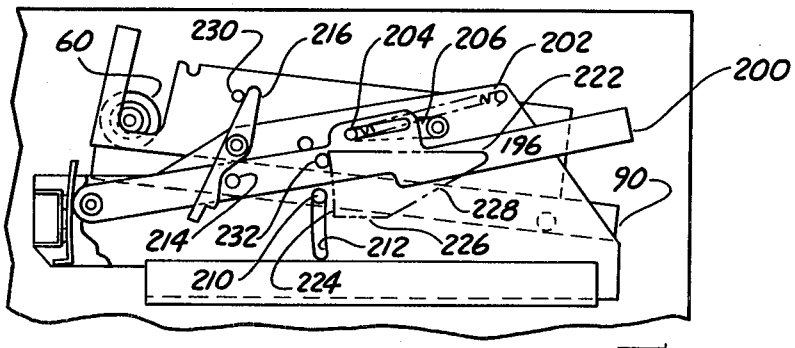
FIG. 3 is a reduced, fragmentary schematic view, in elevation, of the paper-handling apparatus of FIG. 2, showing the supply tray at the feeding position.
Figure 4:
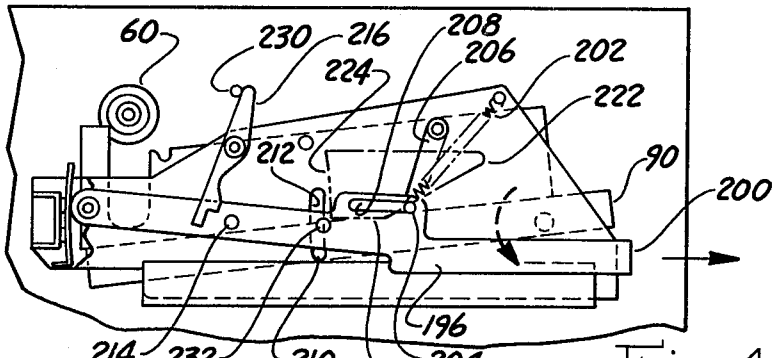
FIG. 4 is a view of the apparatus of FIG. 3 showing the supply tray lowered to the position for withdrawal of tray assembly.

As shown in FIGS. 3 and 4, when the handle 200 is manually lowered, the respective lever arms 196 are lowered against the forces exerted thereon by the respective tension springs 202 and bear downwardly against the respective camming pins 210, to lower the tray 90 against the force 142 (FIG. 80) exerted by the flexure spring 144 on the tray 90. When the lever arms 96 are sufficiently lowered to carry the respective springs 202 across the pivot axis of the crank 206 associated therewith, the spring 202 slidably move the crank pins 204 rearwardly in the respective slots 208; where the respective cranks 206 are held in place by the springs 202. The cranks 206, in turn, hold the lever arms 196 in the lowered position shown in FIG. 3.

To lock the respective lever arms (FIG. 2) in the aforesaid lowered positions, each of the lever arms 196 includes stop 214 fixedly attached to the arm 196 and extending sidewise therefrom forwardly of the tension spring 202; and the frame side walls 114 each have a latching member 216 pivoted thereto for movement into and out of engagement with the stop 214. When the lever arms 196 are disposed in the lowered position, as shown in FIG. 2, and the tray 90 is rearwardly moved as shown in FIG. 3, the lower ends of the respective latching members 216 pivot into abutment with the respective stops 214, under the influence of gravity, to lock the associated lever arms 196 in the lowered position until such time as the upper ends of the latching members 216 are moved toward the rear end of the tray 90 to release the latching members 216 from abutment against the stops 214.

As shown in FIG. 2, the frame side walls 114 are suitably movably attached to the copier framework 12, as by means of a plurality of rollers 218, (one of which is shown in FIG. 2), pivoted to the respective frame side walls 114 and rollably disposed in a channel member 220 of the copier framework 12. With this arrangement, the tray supporting means, and thus the tray 90, may be moved forwardly for disposition of the tray 90 beneath the feed rollers 60 and rearwardly for disposition of the tray 90 in a position which is more easily accessible to the operator for loading copy sheets 48 on the tray 90.

To prevent rearward movement of the tray 90 (FIG. 2), before lowering the copy sheets 48 out of engagement with the feed rollers 60, the copier framework 12 includes a pair of oppositely spaced cam 222, one of which is associated with each of the lever arms 196. Each of the cams 222 has a substantially vertically extending forward cam surface 224, a substantially horizontally extending lower cam surface 226 and an upwardly and rearwardly inclined rear cam surface 228. In addition the copier framework 12 includes a pair of oppositely spaced pins 230 extending towards the respective latching members 216. And, each of the lever arm 196 includes a cam follower pin 232 extending therefrom for engagement with the associated cam 222.

Assuming the tray 90 is located in the forwardly disposed copy sheet feeding position shown in FIG. 3, and an attempt is made to rearwardly move the supply tray 90 without lowering the tray 90; the cam follower 232 (FIG. 3) would be urged into abutment with the forward cam surface 224, thereby preventing rearward movement of the tray 90.

Figure 5:
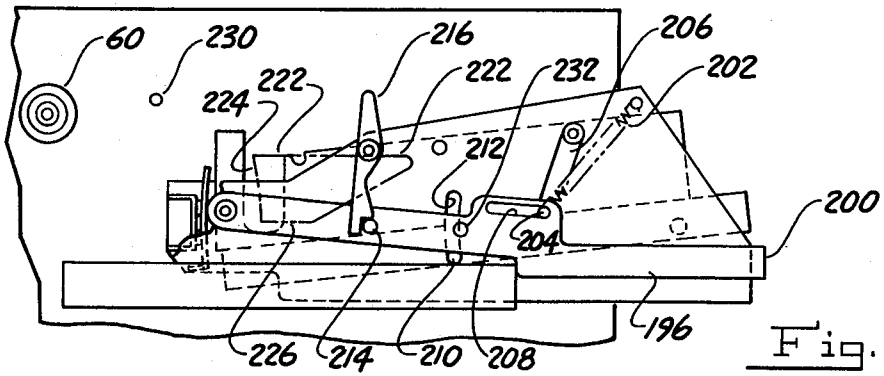
FIG. 5 is a view of the apparatus of FIG. 3, showing the supply tray at the loading position.

To move the tray 90 rearwardly, the handle 200 must first be lowered to the position shown in FIG. 4; causing the cam follower 232 to ride downwardly against the forward cam surface 222. As this occurs, the crank 206 rotates counterclockwise from the position thereof shown in FIG. 3 to the position shown in FIG. 4, thereby carrying the spring 202 across the pivot axis of the crank 206. As a result, the crank pin 204 slides to the rear of the lever arm slot 208. As thus disposed, the arms 196 are lowered sufficiently to permit the camming pin 232 to clear the forward cam surface 224. However, the spring 202 cannot urge the camming pins 232 upwardly against the lower cam surface 226 of the cam 222, since they are restrained from doing so by the cranks 206. The tray supporting means frame 112 and thus the tray 90 can then be moved rearwardly by the operator. As this occurs, the latch 216 pivots under the influence of gravity toward the stop 214, but is prevented from completely doing so by the pin 230 (FIG. 4) bearing against the upper end of the the latch 216, until such time as the tray 90 has been moved sufficiently rearwardly to permit the latch 216 to be disengaged, as shown in FIG. 5, from contact with the pin 230. This occurs before the cam followers 232 clear from the lower cam surface 226; as a consequence of which the operator cannot indavertently raise the lever arms 196, since the cam followers 232 would then be raised into abutment with the lower cam surface 226. Accordingly, the latch 216 pivots into engagement with the pin 214 to lock the lever arms 196 in the lowered position shown in FIG. 5 as the cam follower 232 passes beneath the lower cam surface 226.

Figure 6:
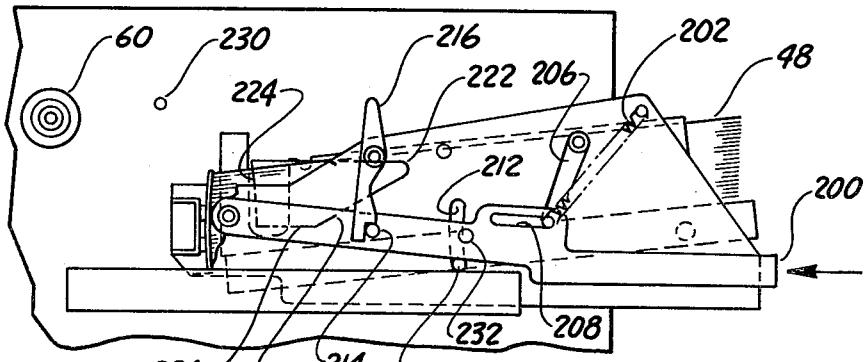
FIG. 6 is a view of the apparatus of FIG. 3 showing the loaded supply tray being moved to the feeding position.
Figure 7:
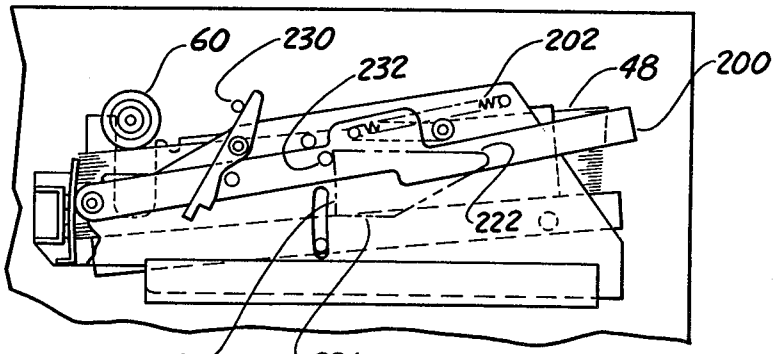
FIG. 7 is a view of the apparatus of FIG. 3, showing the loaded supply tray in the feeding position.

As shown in FIG. 5 the tray has been manually moved rearwardly of the rollers 60 and pins 230. Whereupon a stack of copy sheets 48 (FIG. 6) may be loaded in the tray 90 and the tray 90 pushed forwardly by exerting forward pressure on the lever arm handle 200. When the tray is moved sufficiently forwardly to be disposed in the position shown in FIG. 4, each of the pins 230 tips the upper end of the latch 216 associated therewith to release the lower ends of the latches from abutment with the pins 214. If the operation then raised the lever arms 196 the camming pins 232 would be urged into engagement with the lower camming surface 226 by the springs 202 as the cranks 206 were moved forwardly. Continued forward movement of the tray 90 therefore occurs with the lever arms 196 disposed in the lowered position, whether or not the operation attempts to raise the arms 196, until each of the cam followers 232 clears the intersection between the associated lower cam surface 226 and forward cam surface 224. Whereupon, the operator can raise the lever arms 196, to rotate the cranks 206 clockwise against the tension of the springs 202. When the springs 202 pass over the pivot axis of the respective cranks 206, the springs 202 contract to urge the respective cam followers 232 upwardly along the associated forward cam surfaces 224 until such time as the lever arm 196 are disposed out of engagement with the camming pins 210. As a result of which the flexure spring 144 urges the tray 90 upwardly until the topmost copy sheet 48 (FIG. 7) is disposed in engagement with the feed rollers 60.

In the event that the tray 90 is raised after being moved rearwardly for copy sheet loading purposes, and the operator neglects lowering the handle 200 before forwardly moving the tray 90; such forward movement will urge the respective camming pins 232 into engagement with the associated rear cam surfaces 228 to urge the camming pins 232, and thus the lever arms 196, downwardly, until the respective cranks 206 are disposed, as hereinbefore described, to hold the arms 196 downwardly. Whereupon the respective latches 216 pivot into abutment with the respective pins 214 to lock the lever arms 196 downwardly as hereinbefore discussed. Of course, continued forward movement of the tray 90 would thereafter release the latches 216 as hereinbefore described. Whereupon, the tray 90 could be raised.

In accordance with the objects of the invention there has been described improved apparatus for handling copy sheets and, in particular for evenly distributing the force exerted by the copy sheets on the feed rollers, between the feed rollers. And providing apparatus which facilitates loading copy sheets in a copier.

Inasmuch as certain changes may be made in the above described invention without departing from the spirit and scope of the same, it is intended that all matter contained in the above description or shown in the accompanying drawings shall be interpreted in an illustrative rather than limiting sense. And, it is intended that the following claims be interpreted to cover all the generic and specific features of the invention herein described.

What is claimed is:

1. In a copier, copy sheet handling apparatus comprising:

a. means for feeding copy sheets, said copy sheet feeding means including a pair of feed rollers spaced apart from each other;

b. means for supplying a copy sheet, said supplying means including a tray on which a copy sheet may be loaded, said tray extending substantially transversely through a plane which extends midway between said feed rollers;

c. means for swivelably supporting said tray;

d. means cooperative with said supporting means for moving said tray, said moving means including means for applying a resilient force to said tray substantially in said plane to move said tray toward said rollers for disposition of a copy sheet into engagement with said rollers whereby said force is substantially equally distributed between said rollers, said force applying means including flexure spring means, said flexure spring means including an elongated flexure spring having a free end adapted for exerting said force against said tray, said tray supporting means including means for holding the other end of said flexure spring stationary; and e. said flexure spring holding means including leg means extending from said tray, said holding means including clamping means pivotably attached to said leg means and having a pivot axis, said flexure spring lengthwise extending through said pivot axis, said other end of said flexure spring attached to said clamping means, and said holding means including means for adjustably fixing the position of said clamping means with respect to said pivot axis for changing the energy stored in said flexure spring.

2. In a copier, copy sheet handling apparatus comprising:

a. means for feeding copy sheets, said copy sheet feeding means including a pair of feed rollers spaced apart from each other;

b. means for supplying a copy sheet, said supplying means including a tray on which a copy sheet may be loaded, said tray extending substantially transversely through a plane which extends midway between said feed rollers;

c. means for swiveably supporting said tray;

d. means cooperative with said supporting means for moving said tray, said moving means including means for applying a resilient force to said tray substantially in said plane to move said tray toward said rollers for disposition of a copy sheet into engagement with said rollers whereby said force is substantially equally distributed between said rollers, said flexure spring means including bracket means and roller means, said bracket means attached to said free end of said flexure spring, said roller means mounted for rotation on said bracket means and disposed in contact with said tray for exerting said force on said tray ; and e. said tray supporting means including finger means extending from said tray, and said bracket means including a guide slot formed therein to receive said finger means such that said bracket means and said finger means cooperate to restrain relative movement between said tray and said free end of said flexure spring.

3. In a copier, copy sheet handling apparatus comprising:

a. means for feeding copy sheets, said copy sheet feeding means including a pair of feed rollers spaced apart from each other;

b. means for supplying a copy sheet, said supplying means including a tray on which a copy sheet may be loaded, said tray extending substantially transversely through a plane which extends midway between said feed rollers;

c. means for swiveably supporting said tray;

d. means cooperative with said supporting means for moving said tray, said moving means including means for applying a resilient force to said tray substantially in said plane to move said tray toward said rollers for disposition of a copy sheet into engagement with said rollers whereby said force is substantially equally distributed between said rollers, said force applying means including flexure spring means, said flexure spring means including an elongated flexure spring having a free end adapted for exerting said force against said tray, said tray supporting means including means for holding the other end of said flexure spring stationary; and e. said tray supporting means including a frame, said tray moving means including a lever arm having one end thereof pivotably attached to said frame, said tray moving means including a tension spring having one end thereof attached to said frame and having the other end thereof attached to said lever arm between said ends of said lever arm, said tray moving means including finger means extending from said tray, and the other end of said lever arm adapted for manually pivotably moving said lever arm against the tension of said tension spring and against said finger means for moving said tray away from said rollers against said flexure spring force.

4. The apparatus according to claim 3, wherein said tray supporting means includes means for forwardly and rearwardly positioning said frame, said tray positioning means including means cooperative with said moving means for preventing rearward movement of said frame until said lever arm moves said tray away from said rollers, and said frame including means cooperative with said lever arm for retaining said tray moved away from said rollers.

5. The apparatus according to claim 4, wherein said tray positioning means includes means cooperative with said moving means for moving said tray away from said rollers.

* * * * *

UNITED STATES PATENT AND TRADEMARK OFFICE

CERTIFICATE OF CORRECTION

PATENT NO. : 4,221,375

DATED : September 9, 1980

INVENTOR(S) : Douglas I. Morrison and William Gergely, Jr.

It is certified that error appears in the above—identified patent and that said Letters Patent is hereby corrected as shown below:

Column 2, line 15, the period should be a semi-colon.

Column 3, line 37, change "insufficiently" to -- sufficiently --.

Column 5, line 22, change "the" to -- The --.

Column 6, line 4, change "todepend" to -- to depend --.

Column 7, line 22, change "cam" to -- cams --.

Column 7, line 31, change "arm" to -- arms --.

Column 7, line 65, change "indavertently" to -- inadvertently --

Column 8, line 30, change "arm" to -- arms --.

IN THE CLAIMS:

Column 9, line 47, Claim 2; change "swiveably" to -- swivelably -

Column 10, line 18 Claim 3; change "swiveably" to -- swivelably

Signed and Sealed this

*Eighth* Day of *December 1981*

[SEAL]

*Attest:*

GERALD J. MOSSINGHOFF

*Attesting Officer*

*Commissioner of Patents and Trademarks*